US009326577B1

(12) United States Patent
Gaspari et al.

(10) Patent No.: US 9,326,577 B1
(45) **Date of Patent: *May 3, 2016**

(54) STORAGE, TRANSPORT, AND DISPLAY CARRIER FOR FINE JEWELRY

(71) Applicants: Seda Gaspari, Los Angeles, CA (US); Mike H. Ananighian, Los Angeles, CA (US)

(72) Inventors: Seda Gaspari, Los Angeles, CA (US); Mike H. Ananighian, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/318,428

(22) Filed: Jun. 27, 2014

Related U.S. Application Data

(63) Continuation-in-part of application No. 13/666,800, filed on Nov. 1, 2012, now abandoned, which is a continuation-in-part of application No. 13/072,066, filed on Mar. 25, 2011, now Pat. No. 8,312,990.

(51) Int. Cl.
*A45C 11/04* (2006.01)
*A45C 11/16* (2006.01)

(52) U.S. Cl.
CPC ..... *A45C 11/16* (2013.01)

(58) Field of Classification Search
CPC ..... B65D 65/38; A45C 11/16
USPC ..... 206/6.1, 566, 560, 477, 478, 479, 495, 206/483, 806; 211/85.2
See application file for complete search history.

(56) References Cited

U.S. PATENT DOCUMENTS

| | | | | |
|---|---|---|---|---|
| 3,900,060 | A * | 8/1975 | Shammas | 206/6.1 |
| 4,401,219 | A * | 8/1983 | Mink | 206/566 |
| 4,654,991 | A * | 4/1987 | Jones | 40/617 |
| 4,735,246 | A * | 4/1988 | Niehaus | 206/6.1 |
| 5,121,833 | A * | 6/1992 | Lindsay et al. | 206/6.1 |
| 5,246,103 | A * | 9/1993 | Hicks | 206/6.1 |
| 5,427,230 | A * | 6/1995 | Mattox | 206/6.1 |
| 5,511,873 | A * | 4/1996 | Mech | 312/227 |
| 5,779,033 | A * | 7/1998 | Roegner | 206/6.1 |
| 6,161,686 | A * | 12/2000 | Simon et al. | 206/6.1 |
| 6,273,872 | B1 * | 8/2001 | Friedman | 604/174 |
| 7,481,340 | B2 * | 1/2009 | Murphy | 223/85 |
| 7,673,744 | B1 * | 3/2010 | Henderson | 206/6.1 |
| 2014/0021091 | A1 * | 1/2014 | Egli | 206/736 |

* cited by examiner

*Primary Examiner* — Jacob K Ackun
*Assistant Examiner* — Jenine Pagan
(74) *Attorney, Agent, or Firm* — Stetina Brunda Garred & Brucker

(57) ABSTRACT

A fine jewelry holder adapted for storing, displaying, and transporting fine jewelry and especially for necklaces and bracelets. The jewelry holder having a plurality of snap-strips, with at least two snap-strips having male type snaps arranged thereon and a plurality of the snap-strips having female type snaps arranged thereon. The two male type snap-strips stitched to a base in mutually parallel positions spaced apart and with male snaps facing away from the base. A plurality of parallel, spaced apart female type snap-strips stitched to each said male snap-strip with one end of each female snap-strip stitched under one of the male snap-strips and positioned orthogonal thereto; and pairs of the female snap-strips extending from the opposing male snap strips in mutual collinear convergence and with female snaps facing away from the base.

3 Claims, 4 Drawing Sheets

STORAGE, TRANSPORT, AND DISPLAY CARRIER FOR FINE JEWELRY

CROSS-REFERENCE TO RELATED APPLICATIONS

This application is a continuation-in-part application co-pending with non-provisional patent application Ser. No. 13/666,800, filed on Nov. 1, 2012, which claims priority of non-provisional application Ser. No. 13/072,066 filed on Mar. 27, 2011, now U.S. Pat. No. 8,312,990 issued on Nov. 20, 2012 and claims international date priority therefrom. The subject matter of application Ser. Nos. 13/666,800 and 13/072,066 is hereby incorporated hereinto in its entirety.

BACKGROUND

This disclosure relates to the field of storage and display of fine jewelry and more particularly to such storage and display capable of securing necklaces and bracelets in particular in a manner that is rigid and prevents scuffing and scratching of their surfaces.

BRIEF DESCRIPTION OF THE DRAWINGS

Like reference symbols in the various drawings indicate like elements.

DETAILED DESCRIPTION

FIGS. 1-4 illustrate the presently described apparatus and method of its use. Fine jewelry is expensive and fragile. It must be stored in a manner that prevents scratching, scuffing, and other damage to surfaces. When it is necessary to move a collection of fine jewelry from place to place as in a portable fine jewelry holder the opportunity arises where such fine jewelry items may be damage. This typically may occur when one item rubs against or collides with an adjacent piece. Therefore, it is important to secure fine jewelry pieces to avoid movement when being stored or manipulated during opening and closing, and placing and moving of a necessary jewelry holder. This is especially true for necklaces and some bracelets which due to their pendulosity, tend to move by momentum forces and often scratch or scuff their own parts or parts of adjacent pieces.

Figure 1:
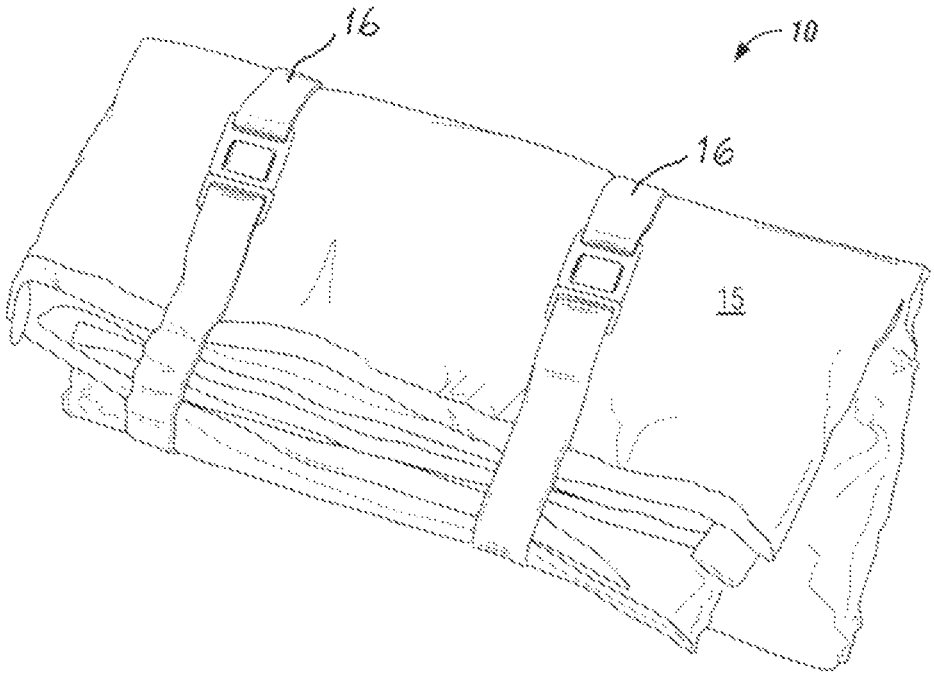
FIG. 1 is an example perspective view of an embodiment of the presently described apparatus in a folded arrangement.
Figure 2:
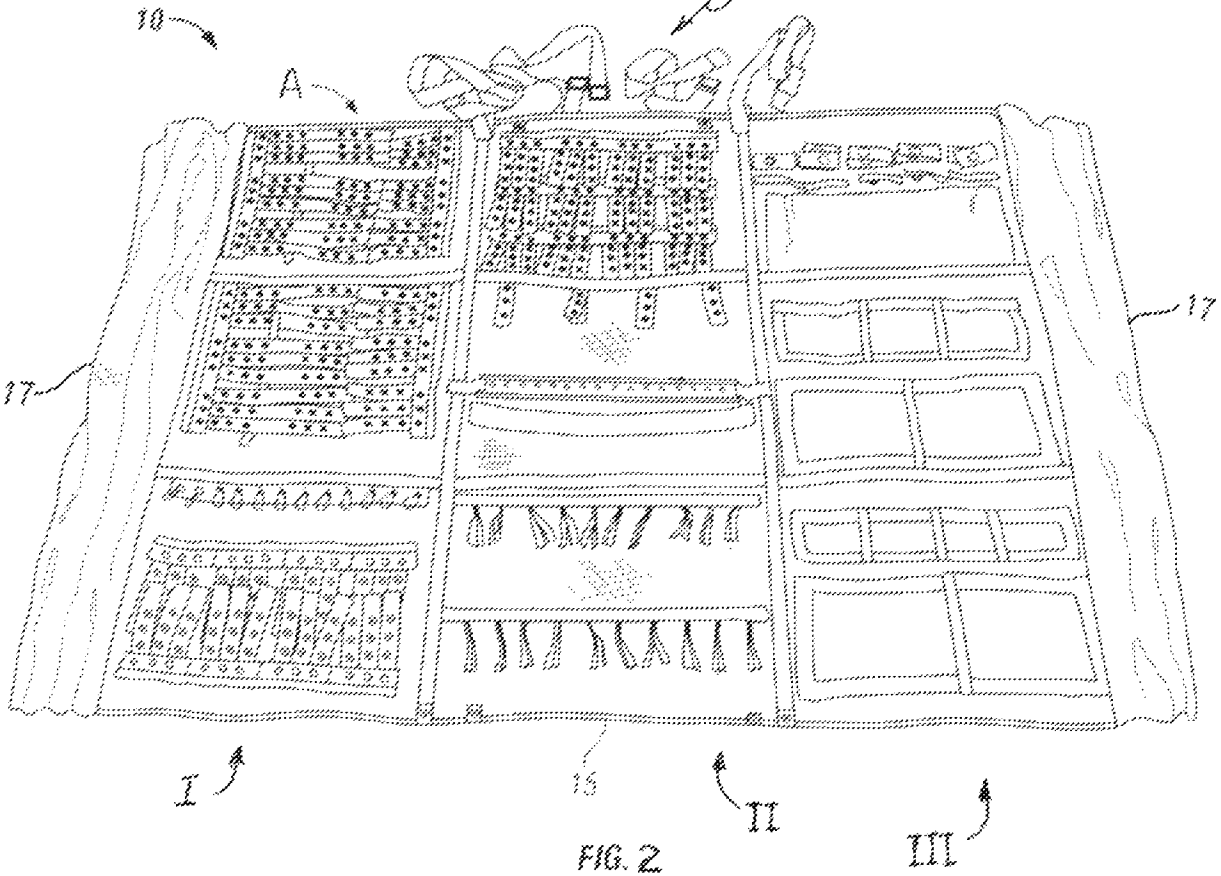
FIG. 2 is a perspective view thereof in an unfolded flat arrangement.

As shown in FIGS. 1 and 2, embodiments of the presently disclosed fine jewelry holder 10 is designed for securely holding fine jewelry pieces 95 in a secure manner. As shown in FIG. 1 fine jewelry holder 10 may have a flexible and foldable fabric base 15 such as a soft material which is easily folded for storage and for carrying from place to place, and may be held in the folded attitude by straps 16. As shown in FIG. 2 fabric base 15 may be unfolded and laid-out as shown preferably on a flat surface. Base 15 may comprise three or more sections, for instance sections I, II, and III in FIG. 2. Covers 17, also of a soft fabric material may be attached to base 15 as shown and may be laid over sections I and III so that jewelry pieces 95 in sections I and III do not contact jewelry pieces 95 in section II when sections I and III are folded over section II and when base 15 is further folded into a form such as shown in FIG. 1.

Figure 3:
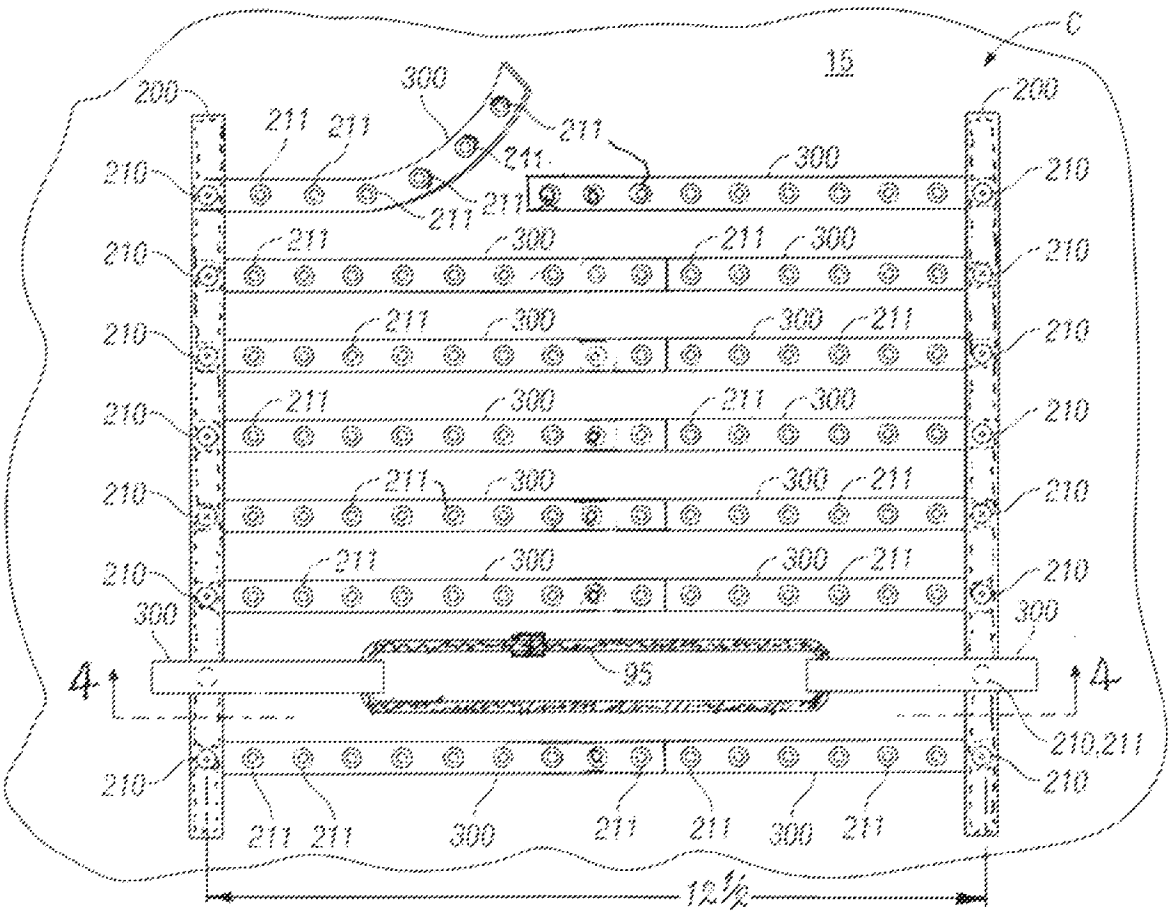
FIG. 3 is a plan view of an arrangement of snap-strips for holding necklaces and bracelets.

In one area of section I shown at the upper-left in FIG. 2, a jewelry holder, set "A," which is specialized for necklaces and bracelets may be engaged with base 15. FIG. 3 shows set "A" enlarged. Set "A" may be made up of snap-strips which are well known in the sewing industry and may be provided by Prym Consumer USA, Inc. of Spartanburg, S.C. or other manufacturers. Snap-strips, in general, are narrow strips of flexible fabric with common snap fasteners attached in a linear sequence running along the fabric strip. The use of snap-strips has advantages which include the highly flexible fabric strips on which the snap fasteners are mounted and the fact that the fasteners are aligned on the strips with even intervals between the fasteners. Snap-strips are commonly used for fastening clothing such as at a blouse's neckline. Snap fasteners, as is well known, are made in male and female versions having either all male or all female fasteners. When a strip of male fasteners is sewn to one side of a garment, and a strip of female fasteners is sewn to the opposite side of the garment, the fasteners on both sides mutually align and the two sides of the garment can be secured together. This application is well known in industry. What is not known is the use of snap-strips for securing fine jewelry in the manner disclosed herein.

Figure 4:
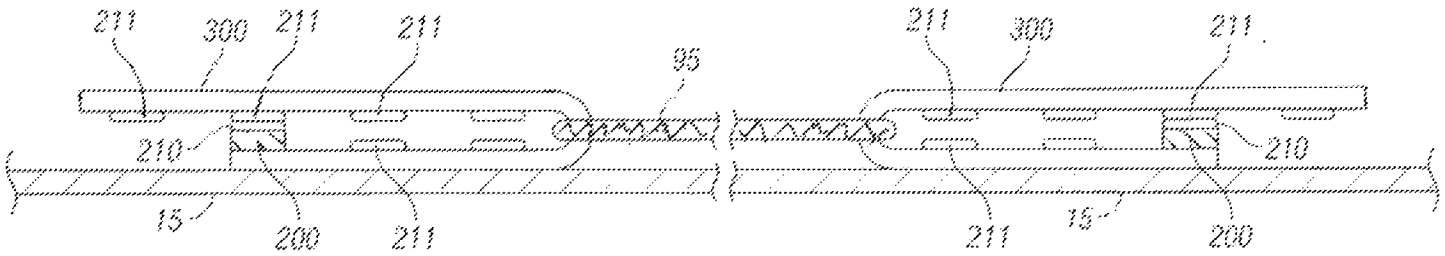
FIG. 4 is partial broken section view according to cutting plane line 4-4 in FIG. 3.

Referring again to FIG. 3, in embodiments, two male snap-strips 200 may be stitched to base 15 using stitches running around all edges of strips 200. This is critically important in that there may be significant forces applied to snap-strips 200 as will be described and as shown in FIG. 4. Snap-strips 200 are positioned in mutually parallel positions, as shown, and are set at 13 inches apart on centers of the snaps 210, but other spacing may used. Female snap-strips 300 are engaged with male snap-strips 200 as shown on the left and right in FIG. 3, that is, one end of the female snap-strips 300 is stitched under the male snap-strips 200 and each strip 300 is positioned orthogonal to strip 200 with each line of female snaps 211 aligned with a male snap 210 of the male strip 200. Stitches penetrate both layers of the snap-strips 200 and 300 as well as base 15.

Various necklaces have different lengths, wherein "length" is defined as the length of the necklace as laid out in a straight line. The vast majority of such necklaces are of standard lengths: 14", 16" 18", 20", and 24". Therefore, these jewelry pieces are approximately 7", 8", 9", 10", and 12" long when clasped as shown in FIG. 3. Of course there are other sizes of necklaces, but the present apparatus is adapted to best accommodate standard length necklaces, while other sizes will also be able to be mounted securely as well and in some cases, a necklace may be doubled or tripled in order to fit the present apparatus and method.

Referring now to FIGS. 3 and 4, it is shown that a necklace is secured between two opposing female snap-strips 211. This is accomplished by bending each female snap-strip back over itself and engaging a female snap 211 with its respective in-line male snap 210 as shown. Because the female snaps 211 are one-inch apart, there is ample space to position the portion of necklace 95 between snaps 211 so there is no metal-to-metal contact between snaps and jewelry. It should be noted that the female snaps 211 in FIG. 3 cannot be fastened to other female snaps 211 on the same snap-strip 300, but must be fastened to a male snap 210 on a respective male snap-strip 300. The distance between the opposing male snaps 210 in line with the female snap-strips 300 is 13". For a 7" long clasped necklace, 6" must be taken up by opposing strips 300. To avoid metal-metal contact, one opposing strip 300 is doubled over by 2½" and the other opposing strip by 3½" for a total of 6". For an 8" long necklace, 5" must be taken up by opposing strips 300, or 2½ on each side. For a 9" long necklace, 4" must be taken up by opposing strips 300, as for instance 1½" on one side and ½" on the opposing side. For a 10" long necklace, 3" must be taken up by opposing strips 300, or 1½" on each side. For a 12" long necklace, 1" must be taken by opposing strips 300, or ½" on each side. As shown, a very wide range of necklace lengths can be accommodated in this same manner because with an odd number of inches on one side and an even number of inches on the other side of a necklace, the necklace can always be fitted between adjacent snaps 211 on both sides.

In summary, it is clear that fine jewelry must be well secured. This is not possible with Velcro-type fastener material since it does not provide a strong and fixed secure hold, but rather tends to creep under the weight of heavy metal jewelry especially jewelry made of precious metals. Precious metal surfaces are easily scratched by Velcro-type material so that contact is not desirable. An improved fastener having a fixed holding position that is not easily undone by the weight of a jewelry article and which does not contact the jewelry article is highly desired. Such a fastener system is described and illustrated herein. This system is not obvious in light of the prior art because it uses snap-strips which are able to be folded back on themselves to form a loop that is fixed by joining snaps, and because such loops are able to be engaged with a jewelry item at opposing positions allowing a mild tension to be formed within the jewelry item so that it cannot loosen or pendulously sway during transport. This approach or any approach similar is not obvious from the combined prior art.

Embodiments of the subject apparatus and method have been described herein. Nevertheless, it will be understood that various modifications may be made without departing from the spirit and understanding of this disclosure. Accordingly, other embodiments and approaches are within the scope of the following claims.

What is claimed is:

1. A combination apparatus and first and second necklace type jewelry, the apparatus capable of storing, displaying, and transporting the first necklace type jewelry and the second necklace type jewelry, parallel and side by side to each other, the combination comprising:

the first and second necklace type jewelry; and the apparatus comprising:

a base;

a first row of at least four discrete first type snaps disposed on the base, the at least four discrete first type snaps of the first row being evenly spaced apart from each other;

a second row of at least four discrete first type snaps disposed on the base, the at least four discrete first type snaps of the second row being evenly spaced apart from each other and such spacing between the at least four discrete first type snaps of the second row being equal to a spacing defined by the at least four discrete first type snaps of the first row, the first and second rows being parallel to each other, a first discrete first type snap in the first row aligned to a first discrete first type snap in the second row and a second discrete first type snap in the first row aligned to a second discrete first type snap in the second row so that the first necklace type jewelry which is secured to the aligned first discrete first type snaps of the first and second rows is parallel to the second necklace type jewelry which is secured to the aligned second discrete first type snaps of the first and second rows;

a first strip of discrete second type snaps attached to the base so that the discrete second type snaps of the first strip are removably attachable to the first discrete first type snap of the first row, the first strip of discrete second type snaps extending toward the second row of discrete first type snaps then bent back over itself and away from the second row when holding the first necklace type jewelry;

a second strip of discrete second type snaps attached to the base so that the discrete second type snaps of the second strip are removably attachable to the first discrete first type snap of the second row, the second strip of discrete second type snaps extending toward the first row of first type snaps then bent back over itself and away from the first row when holding the first necklace type jewelry;

a third strip of discrete second type snaps attached to the base so that the discrete second type snaps of the third strip are removably attachable to the second discrete first type snap of the first row, the third strip of discrete second type snaps extending toward the second row of discrete first type snaps then bent back over itself and away from the second row when holding the second necklace type jewelry;

a fourth strip of discrete second type snaps attached to the base so that the discrete second type snaps of the fourth strip are removably attachable to the second discrete first type snap of the second row, the fourth strip of discrete second type snaps extending toward the first row of discrete first type snaps then bent back over itself and away from the first row when holding the second necklace type jewelry.

2. The combination of claim 1 wherein the discrete first type snaps are male type snaps and the discrete second type snaps are female type snaps.

3. The combination of claim 2 wherein the male type snaps are attached to the base and the first and second rows of discrete male type snaps are stitched to said base in mutually parallel positions spaced apart by one of 5½ inches for bangles and 11 and 13 inches for necklaces.

* * * * *